United States Patent [19]

Bucefari et al.

[11] Patent Number: 4,644,175

[45] Date of Patent: Feb. 17, 1987

[54] DEVICE FOR THE AUTOMATIC CONTROL OF THE FEED OF A TUBULAR WIRE, IN PARTICULAR MADE OF PRECIOUS MATERIAL IN THE GOLDSMITH INDUSTRY

[75] Inventors: Massimo Bucefari; Roberto Rubechini, both of Arezzo, Italy

[73] Assignees: I.C.M. S.p.A. Italiana Costruzioni Metalmeccaniche; T.E.M. s.r.l. Tecnologie Elettroniche e Meccaniche, both of Arezzo, Italy

[21] Appl. No.: 720,306

[22] Filed: Apr. 5, 1985

[30] Foreign Application Priority Data

Apr. 19, 1984 [IT] Italy ..... 9377 A/84

[51] Int. Cl.[4] ..... G01N 21/84

[52] U.S. Cl. ..... 250/561

[58] Field of Search ..... 250/222.1, 560, 561

[56] References Cited

U.S. PATENT DOCUMENTS 4,467,215 8/1984 Kato ..... 250/560 X

FOREIGN PATENT DOCUMENTS 2507447 12/1982 France .

*Primary Examiner*—Eugene R. LaRoche
*Assistant Examiner*—Robert J. Pascal
*Attorney, Agent, or Firm*—Browdy and Neimark

[57] ABSTRACT

A device for the automatic control of the feed of a tubular wire, made of precious or non-precious material, in goldsmith industry machine tools, that allows to maintain a predetermined orientation of the continuous longitudinal groove present on the wire itself. The device comprises the use of sensing means, in particular of the optical kind, for following the groove and its displacements within a predetermined operative band. Means are moreover provided for the rotation of the wire around its axis that are driven by said sensing means: when the groove goes out of said operative band, the wire is automatically rotated in one or the other sense up to bring back the groove within said band. This control is presently made upon sight by the operator.

7 Claims, 4 Drawing Figures

DEVICE FOR THE AUTOMATIC CONTROL OF THE FEED OF A TUBULAR WIRE, IN PARTICULAR MADE OF PRECIOUS MATERIAL IN THE GOLDSMITH INDUSTRY

BACKGROUND OF THE INVENTION

The present invention is a device for the automatic control of the feed of a tubular wire, in particular made of precious material used in the goldsmith industry. It is known to use tubular wire in the goldsmith industry, made of precious or non-precious material, for the production of chains, bracelets and similar products of jewelry or trinkets shops. The use of tubular wire, is particularly convenient, in that it allows a remarkable reduction of the weight, and consequently of the cost, of the finished product without modifying appreciably the aesthetic appeal.

This kind of wire, known also as hollow wire, is generally obtained from a ribbon of the desired material, for instance gold, and from another wire of another non-precious material, for instance copper, aluminum or iron, that acts as a support or core upon which said ribbon is folded over, for instance by a process of drawing. The composite wire thus obtained is suitable for being worked on the machine tools commonly used in the goldsmith industry without danger of damage or deformation. When the desired product has been obtained, the core of non-precious material is eliminated by means of suitable solvents that are inert in respect of the external precious coating. This kind of wire shows a longitudinal cut or groove delimited by the opposite edges of the starting ribbon applied over the internal core. This groove does not develop parallel to the axis of the wire, but it has a generally helicoidal trend due both to the operative modes with which the application of said ribbon is made, and to the manner in which the wire is wound on the take-up coils provided for this purpose. It is clear that in the finished products the groove in question should not be easily visible, i.e. it should be in the internal part of the surface of the several links. The basic problem encountered therefore in the use of this kind of wire is that it should be fed to the machine tool in such a way so that the groove in question is placed always in the same predetermined position.

Presently the control of the position of the groove is made upon sight by the operator of the machine, who provides manually, during the unwinding of the wire from the coil, an angular displacement with respect to the unwinding axis of the coil itself in one direction or another to compensate for the displacement of the groove and to bring it back to the predetermined position. It is clear that in this way the quality of the obtained product will depend in a large measure upon the skill and the carefulness of the operator, as well as upon the dimensions of the wire in movement, because it is more difficult to follow the groove by sight with the decrease of the diameter of the wire. Moreover, each completely automatic machine tools needs an operator performing solely the control of the feed.

OBJECTS OF THE INVENTION

The purpose of the present invention is to provide a device that furnishes the automatic control of the feed of tubular wire to the goldsmith industry machine tools resolving the above mentioned inconveniences.

According to a basic feature of the present invention, the use of sensing means is considered, in particular of the optical kind for delimiting, on the surface of the running wire, an operative band having a predetermined width containing such a groove as that mentioned above and capable of producing a suitable signal whenever the groove passes outside the limits of the band. Means are provided, servoed to the sensing means for rotating the wire around its longitudinal axis, so that when the sensing means detect that the groove is outside either of the limits of the operative band, sensing means produce a corresponding signal that, processed according to suitable logics, operates means for the rotation of the wire in a direction opposite to the direction of shifting of the groove to bring it back within the operative band. In particular, for realizing the rotation of the wire, motor means, controlled by the signals coming from said sensing means, rotate the support on which the coil is wound around the running direction of the wire. With the device according to the present invention the control of the feed of the tubular wire is made automatically with the precision appreciably higher than that obtained with the visual check and entirely constant in time, i.e. not conditioned by fatigue of the operator, who may be entrusted with the contemporaneous supervision of several machine tools that may operate, at least for certain time intervals, also without him.

BRIEF DESCRIPTION OF THE DRAWINGS

Further features and advantages of the device according to the present invention will be more clear from the following description of an embodiment thereof, made as a non-limitative example with reference to the attached drawings, wherein.

DETAILED DESCRIPTION OF THE INVENTION

Figure 4:
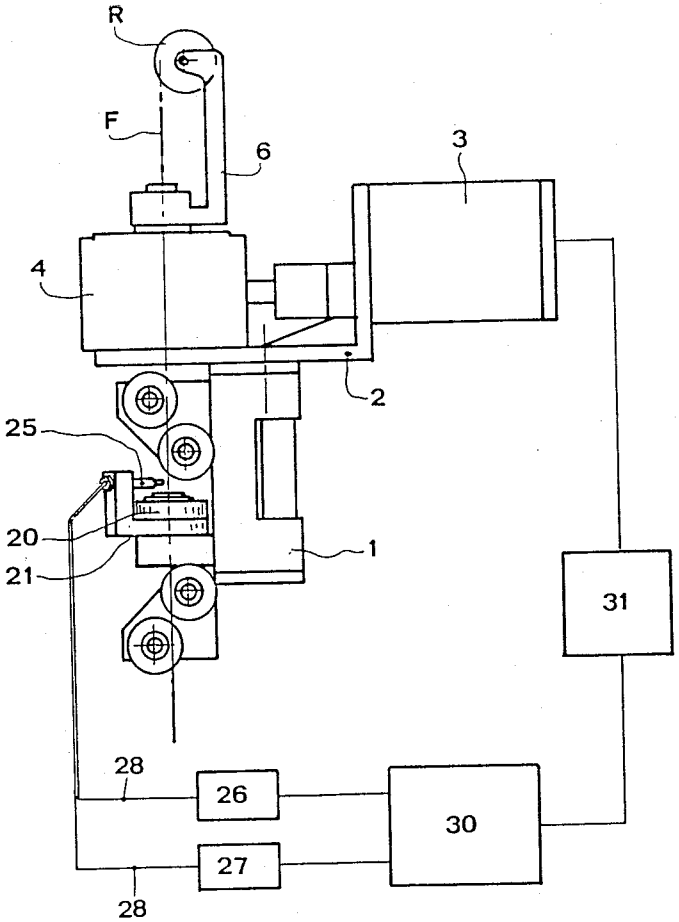
FIG. 4 illustrates schematically the device according to the invention as a whole and its operative logic.
Figure 2:
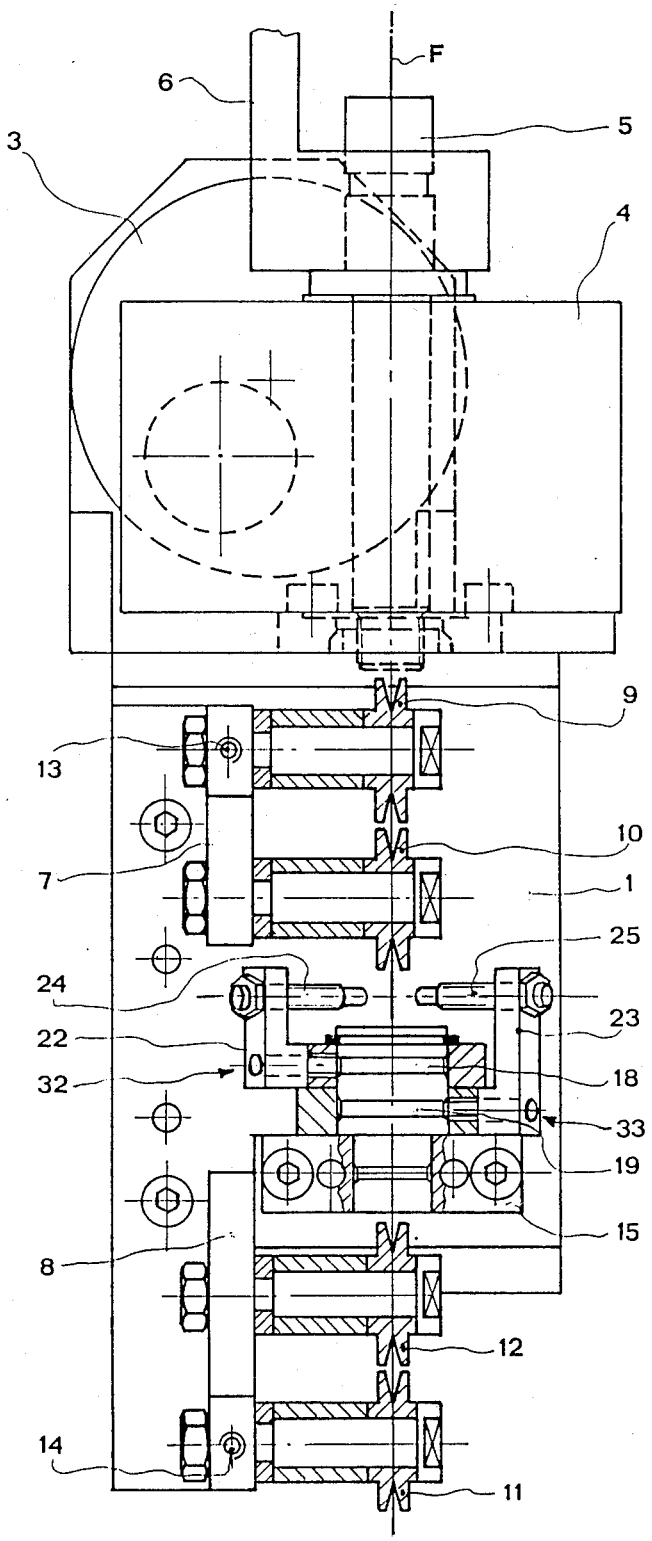
FIG. 2 is a front view, partially in section, of the device according to the invention.
Figure 3:
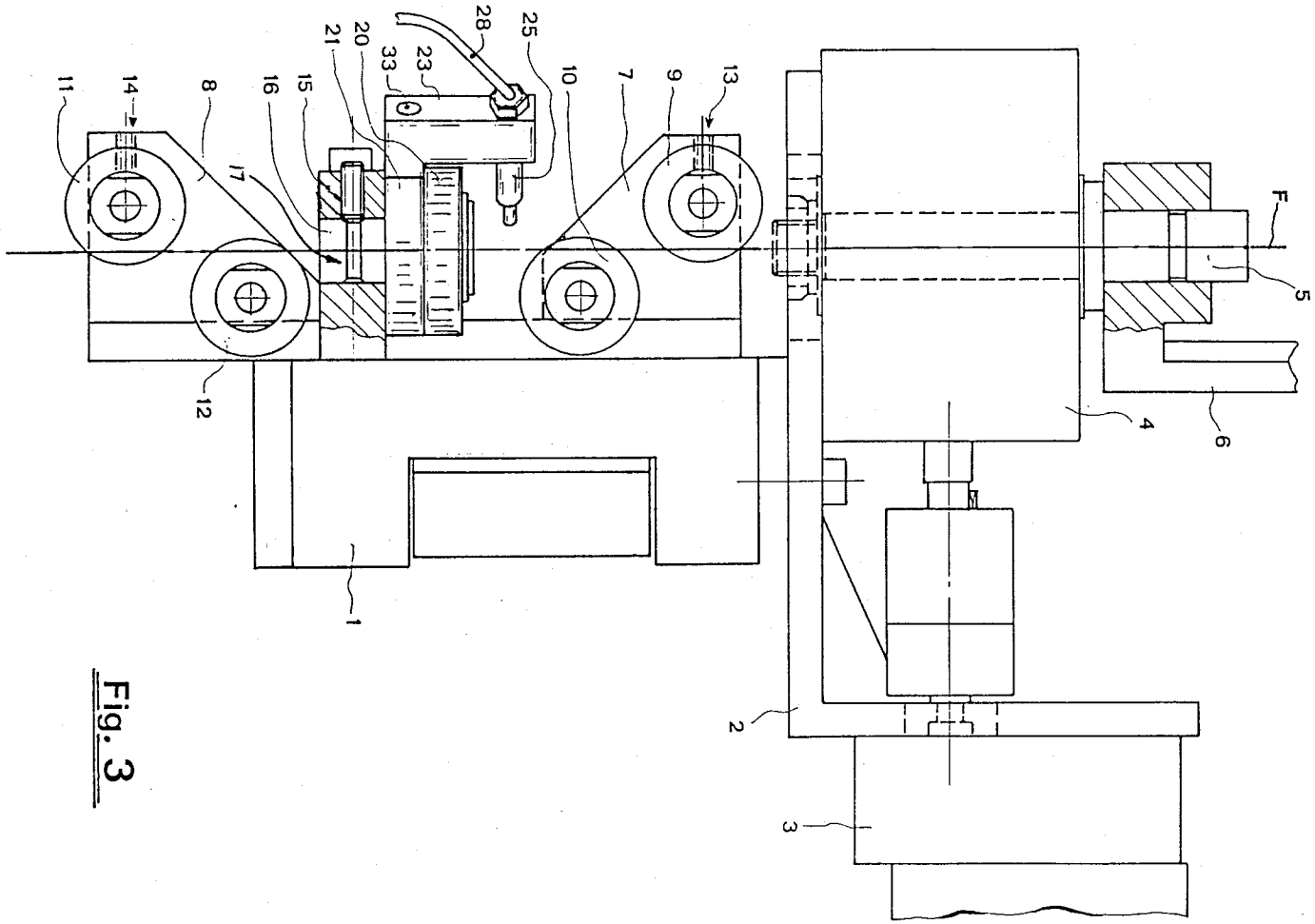
FIG. 3 is a lateral elevation view of the device according to the invention.

With reference to the abovesaid figures, and in particular to FIGS. 2 and 3, there has been indicated with 1 a metallic support suitable to be applied on the structure of a goldsmith industry machine tool in a wire feed station, said support 1 carrying on the upper side a bracket 2 for supporting a motor 3 and a speed reducer gear 4 suitably interconnected in a known way. The output shaft of the speed reducer gear 4 carries integrally therewith a bracket 6 at the top end on which is mounted, in a known way, a coil R (shown only in FIG. 4) for a tubular wire F, the running direction of which (i.e. the direction of unwounding from coil R) is shown with a dotted and dashed line in the figures. The shaft 5 is internally hollow to allow the passage of the wire through the speed reducer gear 4. The support 1 carries further laterally, under the bracket 2 in correspondence with the speed reducer gear 4, two wings 7 and 8 vertically spaced from each other. The wings 7 and 8 support guide means for the wire F extending from the hollow shaft 5 of the speed reducer gear 4, the guide means comprising two pairs of grooved wheels 9 and 10, on the wing 7, and 11 and 12, on the wing 8. The wheels of each pair are coplanar, opposed and vertically offset relative to each other so that the wire runs on the bottom of the respective grooves. The center-to-center distance between the wheel of each pair is adjustable so that the tension of the wire F may be trimmed. To this end the axis of the wheels 9 and 11 may be shifted horizontally by operating the respective adjustment pins 13 and 14.

Figure 1:
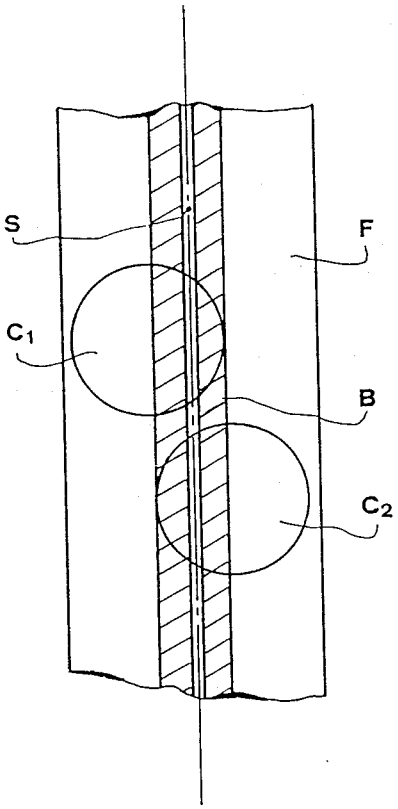
FIG. 1 shows schematically the principle of operation of the device.

Between the two wings 7 and 8 a table 15 protrudes horizontally, supported by the support 1. The table is provided with a through hole 16, aligned to and coaxial with the shaft 5, within which there is housed a tubular member 17 coaxial with the running direction of the wire. On the part of the tubular member 17 that protrudes above the hole 16 two annular slide guides 18 and 19 are machined to engage correspondingly two superposed rings 20 and 21 capable of rotating around the tubular member 17, but locked in an axial sense. The two rings 20 and 21 carry two vertical arms 22 and 23 at the ends of which are optically-sensitive parts 24 and 25 of two photocells 26 and 27 (shown only in FIG. 4) are fastened. More precisely, the connection between the photocells 26 and 27 and the sensors 24 and 25 is realized by means of optical fiber connections 28. The sensors 24 and 25 are substantially placed between the first pair of grooved wheels 9 and 10 and the tubular member 17, and their optical axis is horizontal and convergent towards the running wire F. The sensors also may be complanar or slightly offset, in such a way so that, as it is shown in FIG. 1, their optical fields indicated with C1 and C2 show an area of partial superposition. The superficial band of the running wire F involved with the partial superposition area of the two optical fields C1 and C2 constitutes the operative band B of the device, i.e. that band within which the device operates for maintaining the longitudinal groove S of the wire during its running. The width of said band is greater or, at the limit, equal to the width of the groove 6. The two photocells 26 and 27 are connected to a control circuit for the signals they produce that controls actuator means 30 of the rotation of the motor 3, so that motor 3 may rotate in opposed directions.

The operation of the device is as follows. While the groove S maintains itself within the operative band B defined by the superposed parts of the optical fields C1 and C2 of the sensors 24 and 25, the motor 3, that produces the rotation of the support 6 of the coil where the wire F is wound, around its running direction, is at a standstill. When the wire goes beyond the right or left limit of the band B (refer to FIG. 1) entering in the optical fields, C1 of the sensor 24 or C2 of the sensor 25, respectively, the photocells 26 or 27 produce a signal that is sent through the control circuit 29 to the actuator means 30 for the rotation of the motor 3 that will rotate in one or the other direction in order to impart a counterclockwise or clockwise rotation, respectively, to the support 6 of the coil and consequently to the wire F. When the groove S has been brought back within the operative band B, falling within the optical field of both the photocells, the motor 3 receives a stop command. If, then, the groove S passes out of the optical fields of both the photocells (this may happen at the beginning of the feed or in the event that on the wire a portion of groove is present having a width smaller than the intrinsic sensitivity of the photocells), the motor 3 will be made to rotate indifferently in one or the other direction until the groove encounters the optical field of one of the photocells. The motor then continues to rotate in the same direction until the groove S is brought back in the operative band B. The control circuit 29 is essentially comprised of a comparator for the signals coming from the two photocells operating in such a way so as to prevent energization of the motor 3 when both photocells "see" the groove, so as to command the right rotation or the left rotation of the motor when the signal comes from one or the other of the two photocells, and finally to command the rotation in one or the other direction when no signal comes from the two photocells so as to maintain such direction of rotation until the groove comes back within the operative band B. The control circuit 29 may be realized in any manner, for instance by means of interconnected relays or with electronic components.

The operative band B of the device may be delimited in a manner different from the one above described and illustrated in FIG. 1. For instance, it is possible to arrange the whole so that the optical fields C1 and C2 of the sensor 24 and 25 do not show overlapping areas; in this case the width of the operative band will correspond to the distance between the boundaries of the two optical fields. With respect to this solution, the one previously detailed remains the preferred one because in this latter case, energization of the motor 3 will have to be maintained when the groove is within the limits of the operative band, the signals that the two sensors provide being equal when it is in this position and in the opposed position with respect to the optical fields of the sensors.

The angle under which the two sensors 24 and 25 observe the wire may be modified by suitably rotating the rings 20 and 21 and then locking them with pins 31 and 32.

The device according to the invention may be installed on any goldsmith industry machine tool provided with own means for the transport and feed of the wire.

Changes and/or modifications may be introduced in the device for the automatic feed of a tubular wire, in particular made of precious metal, according to the present invention, without for this departing from the scope of protection of the invention itself.

We claim:

1. A device for the automatic control of the feed of a tubular wire, in particular made of precious metal, in goldsmith industry machine tools, said wire having a continuous longitudinal groove and being continuously unwound in a running direction from a take-up coil for the action of transport means of said machine, characterized in that sensing means are provided for sensing the displacement of said groove with respect to an operative band defined by said sensing means on the surface of the wire containing said groove, said band having a predetermined width not smaller than the width of said groove, there being further provided means, servoed to said sensing means for rotating said wire around its longitudinal axis in one direction or another in correspondence with displacements of said groove with respect to said operative band.

2. A device according to claim 1, wherein said sensing means comprises two photocells having optically-sensitive elements oriented in angularly spaced directions toward the wire thereby defining with the respective optical fields said operative band, said photocells producing a signal suitable for controlling the energization of said rotating means for the wire when said groove is outside said operative band in the optical field of only one of said sensitive elements.

3. A device according to claim 2, wherein the optical fields of said sensitive elements are partially overlapped, said operative band being delimited by the interaction of the wire with both the fields.

4. A device according to claim 1, wherein said means for rotating the wire around its own axis in correspondence with displacements of said groove beyond the limits of said operative band includes motor means suitable for rotating the support of the coil, on which said wire is wound, with respect to the running direction of the wire itself, said motor means being servoed to said sensing means through a control circuit and means for commanding rotation of said support.

5. A device according to claim 4, wherein said control circuit comprises a comparator for the signals produced by said photocells relative to the presence or absence of the groove within the respective optical fields, said comparator generating a control signal for the rotation of the motor in a first direction or a second opposite direction when a signal representing the presence of said groove comes from one or the other of said photocells, a stop signal for said motor when a signal representing the presence of said groove comes from both the photocells and a control signal for preventing the rotation of said motor in either of the two directions when no signal representing the presence of said groove comes from either of the two photocells.

6. A device according to claim 1, wherein a tubular body is provided within which the wire runs, said tubular body carrying two coaxial rings fixed axially thereon and rotatable therearound, and respective arms extending from said rings parallel to the running direction of the wire carrying the sensitive parts of said photocells, there being provided guide means for the wire upstream and downstream with respect to the tubular body.

7. A device according to claim 1, wherein said sensing means comprises two optical-fiber photocells.

* * * * *